US006457240B1

(12) United States Patent
Liu

(10) Patent No.: US 6,457,240 B1
(45) Date of Patent: Oct. 1, 2002

(54) ANTI-DETACHMENT STRUCTURE FOR A KNIFE AND KNIFE SHEATH

(76) Inventor: Yen-Fei Liu, No. 13-1, Lane 32, Hsi Liu Street, Ta-Li City, Taichung Hsien (TW)

( * ) Notice: Subject to any disclaimer, the term of this patent is extended or adjusted under 35 U.S.C. 154(b) by 0 days.

(21) Appl. No.: 09/837,269

(22) Filed: Apr. 19, 2001

(51) Int. Cl.[7] ..... B26B 29/02
(52) U.S. Cl. ..... 30/162; 30/151; 224/232
(58) Field of Search ..... 30/151, 162, 163; 224/232

(56) References Cited

U.S. PATENT DOCUMENTS 2,098,139 A * 11/1937 Foley et al. ..... 224/232
4,964,554 A * 10/1990 Collins ..... 224/232

* cited by examiner

*Primary Examiner*—Douglas D. Watts
(74) *Attorney, Agent, or Firm*—Rosenberg, Klein & Lee

(57) ABSTRACT

An anti-detachment structure for a knife and knife sheath, including a knife and a knife sheath. The knife has a fixing section and the knife sheath is provided with a resilient member and a linearly movable driving block. By means of coordinate operation of the driving block, resilient member and fixing section, the knife can be easily extracted out of the knife sheath.

7 Claims, 6 Drawing Sheets

ANTI-DETACHMENT STRUCTURE FOR A KNIFE AND KNIFE SHEATH

BACKGROUND OF THE INVENTION

The present invention is related to an anti-detachment structure for a knife and knife sheath. The anti-detachment structure is able to firmly fix the knife in the knife sheath without unexpected detachment, while permitting the knife to be conveniently extracted from the knife sheath.

FIG. 5 shows a conventional knife and knife sheath structure 9. A strap 94 is disposed on one side of the knife sheath 91 and has a fastener 96 (such as a buckle) at free end 95. Another fastener is disposed on the other side of the knife sheath 91. The strap 94 can be crossed over the opening 93 of the knife sheath 91 to fasten the fastener 96 on the other fastener. Accordingly, the knife 98 is prevented from detaching from the knife sheath 91. When taking out the knife, it is necessary to first unfasten the fastener 96 with index finger and thumb. However, the index finger and thumb apply a force onto the fastener in a direction which is not coordinate with the direction in which the knife is extracted. Therefore, the knife can be hardly smoothly and quickly extracted.

Alternatively, as shown in FIG. 6, the inner wall face 92 of the knife sheath 91 is formed with multiple protuberances 97 near the opening 93. The protuberances 97 engage with the handle of the knife to locate the knife, permitting the knife to be directly extracted out of the knife sheath 91. However, the protuberances generally can hardly tightly locate the knife in the knife sheath 91. On the other hand, in case the protuberances too tightly engage with the knife, it will be difficult to extract the knife. Therefore, it is necessary to provide an anti-detachment structure which is able to firmly fix the knife in the knife sheath without unexpected detachment, while permitting the knife to be conveniently extracted from the knife sheath.

SUMMARY OF THE INVENTION

It is therefore a primary object of the present invention to provide an anti-detachment structure for a knife and knife sheath. The anti-detachment structure is able to firmly fix the knife in the knife sheath without unexpected detachment, while permitting the knife to be conveniently extracted from the knife sheath. The anti-detachment structure includes a knife and a knife sheath. The knife has a handle and a blade received in the knife sheath. The handle has a fixing section having a guide face directed to the blade and a stop face back to the blade. A resilient member and a linearly movable driving block are disposed in the knife sheath. By means of drivingly operating the guide face, stop face, resilient member and the driving block, the knife can be firmly fixed in the knife sheath without unexpected detachment. Also, the knife can be easily and conveniently extracted out of the knife sheath.

The present invention can be best understood through the following description and accompanying drawings wherein:

DETAILED DESCRIPTION OF THE PREFERRED EMBODIMENTS

Figure 1:
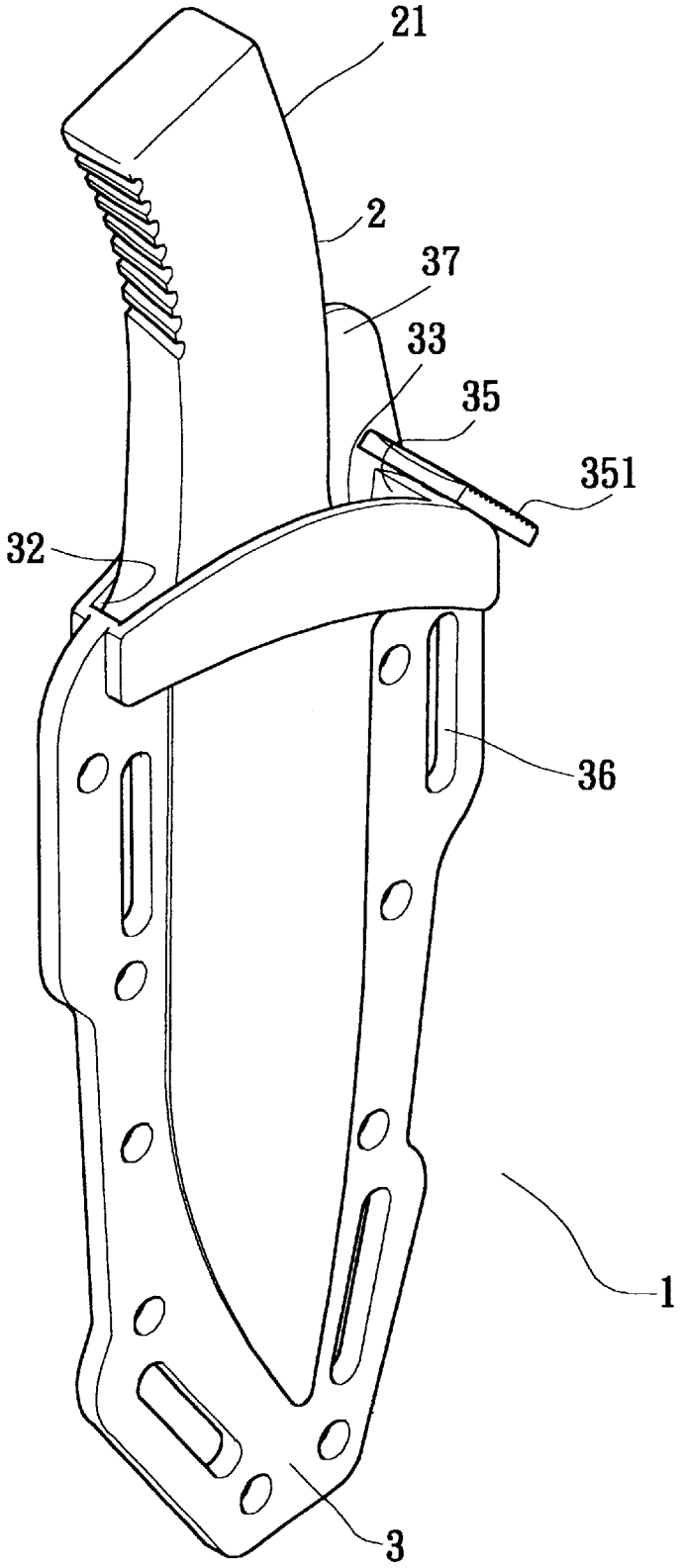
FIG. 1 is a perspective assembled view of the present invention.
Figure 2:
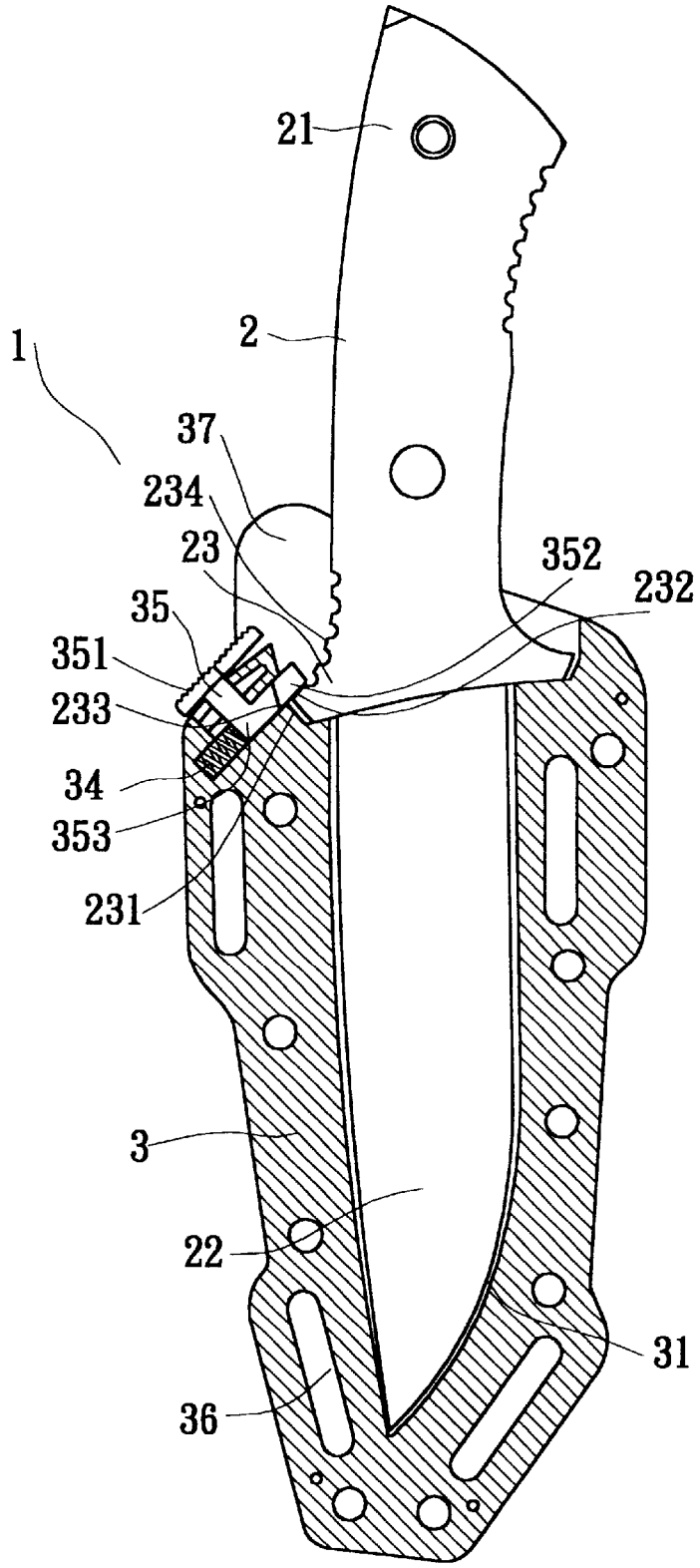
FIG. 2 is a partially sectional view of the present invention.
Figure 3:
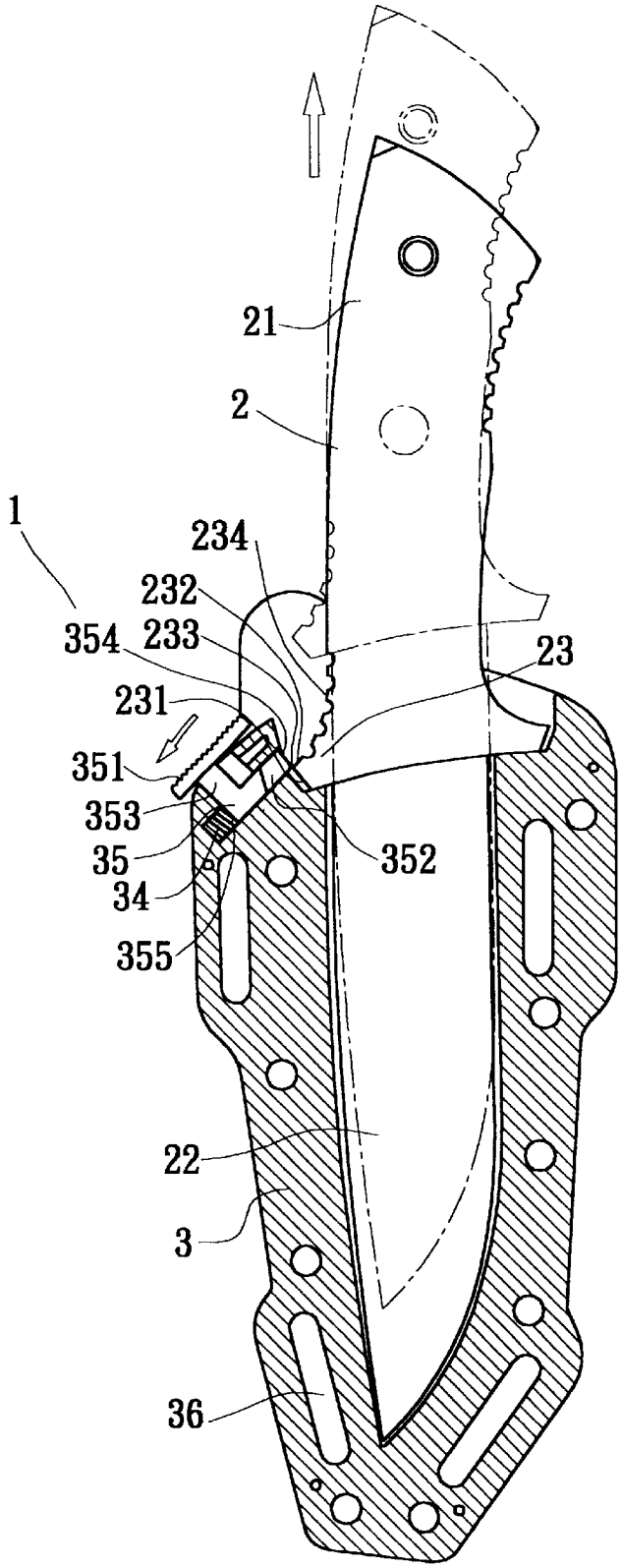
FIG. 3 is a view according to FIG. 2, showing that by means of moving the driving block, the knife is fixed in the knife sheath.

Please refer to FIGS. 1 to 3. The anti-detachment structure 1 of the present invention includes a knife 2 and a knife sheath 3. The knife 2 has a handle 21 and a blade 22. The handle 21 has a fixing section 23. When a user holds the handle 21, the fixing section 23 faces the space between the thumb and the index finger. The fixing section 23 has a guide face 231 directed to the blade 22 and a stop face 232 back to the blade 22. The guide face 231 and the stop face 232 define a ridge section 233. In this embodiment, a toothed slip proof face 234 extends from the stop face 232 back to the blade 22. Alternatively, the fixing section 23 can more extends upward, whereby when a user's hand holds the handle 21, the fixing section 23 serves to protect the hand.

The knife sheath 3 has an interior receiving space 31 with a profile complementary to the blade 22 for receiving the blade 22. The receiving space 31 has an opening 32 facing outward. The opening 32 is defined by an opening periphery 33 of the knife sheath 3. A resilient member 34 and a linearly movable driving block 35 are disposed in the knife sheath 3 corresponding to the fixing section 23. The driving block 35 has a push face 351, a stop block 352 and a connecting block 353 connected between the push face 351 and the stop block 352. The push face 351 extends out of the knife sheath 3 and is positioned on the opening periphery 33. When a user holds the handle of the knife 2 fixed in the knife sheath 3, the direction of the thumb corresponds to the push face 351. The stop block 352 has an outer end face 354 facing the opening periphery 33 and an inner end face 355 contacting with the resilient member 34. In this embodiment, the outer end face 354 is a slope corresponding to the guide face 231 of the fixing section 23.

In addition, the outer periphery of the knife sheath 3 is formed with multiple through holes 36 through which a cord can be passed to tie the knife sheath 3 on a user's body. A protective plate 37 outward extends from a lateral side of the opening 32. In this embodiment, the protective plate 37 only outward extends from the lateral edge of the opening 32 near the fixing section 23. When the user wears the knife sheath 3, the protective plate 37 is attached to the user's body.

When inserting the knife 2 into the knife sheath 3, the guide face 231 of the fixing section 23 correspondingly faces the outer end face 354 of the stop block 352, so that the outer end face 354 is easily pushed by the guide face 231 to make the inner end face 355 compress the resilient member 34 and push away the stop block 352. At this time, the knife 2 is permitted to move forward. When the ridge section 233 of the fixing section 23 passes through the stop block 352, the stop block 352 is moved back to its home position and engaged with the stop face 232 of the fixing section 23. Therefore, the knife 2 is firmly fixed in the knife sheath 3.

When extracting the knife 2 from the knife sheath 3, the user first holds the handle 21 with the direction of the thumb corresponding to the push face 351 of the driving block 35. Under such circumstance, the user can easily contact with the push face 351 and push the driving block 35 to compress the resilient member 34. Accordingly, the driving block 35 is linearly entirely pushed away. At this time, the other four fingers and the palm can apply a force to the knife 2 for extracting the same out of the knife sheath 3. The direction of the force applied by the thumb onto the push face 351 is reverse to the extraction direction of the knife 2. Therefore, the user can conveniently and coordinately extract the knife 2.

When wearing the knife sheath 3, the protective plate 37 of the knife sheath 3 is attached to the user's body and positioned between the knife 2 and the user's body. Therefore, the protective plate 37 serves to protect the user from being injured by the knife 2. Moreover, when using the knife 2 and applying a forward force onto the knife 2, the fixing section 23 serves to protect the user from being incautiously injured by the blade 22.

Figure 4:
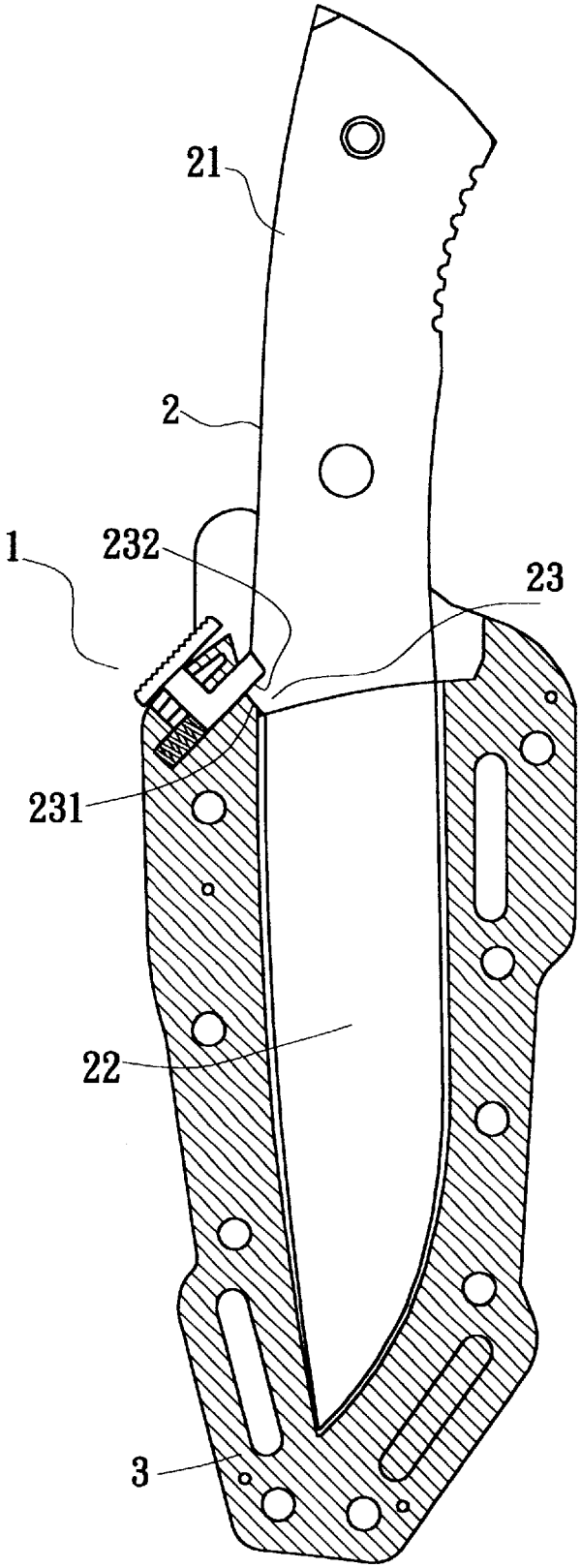
FIG. 4 is a partially sectional view of a second embodiment of the present invention.
Figure 5:
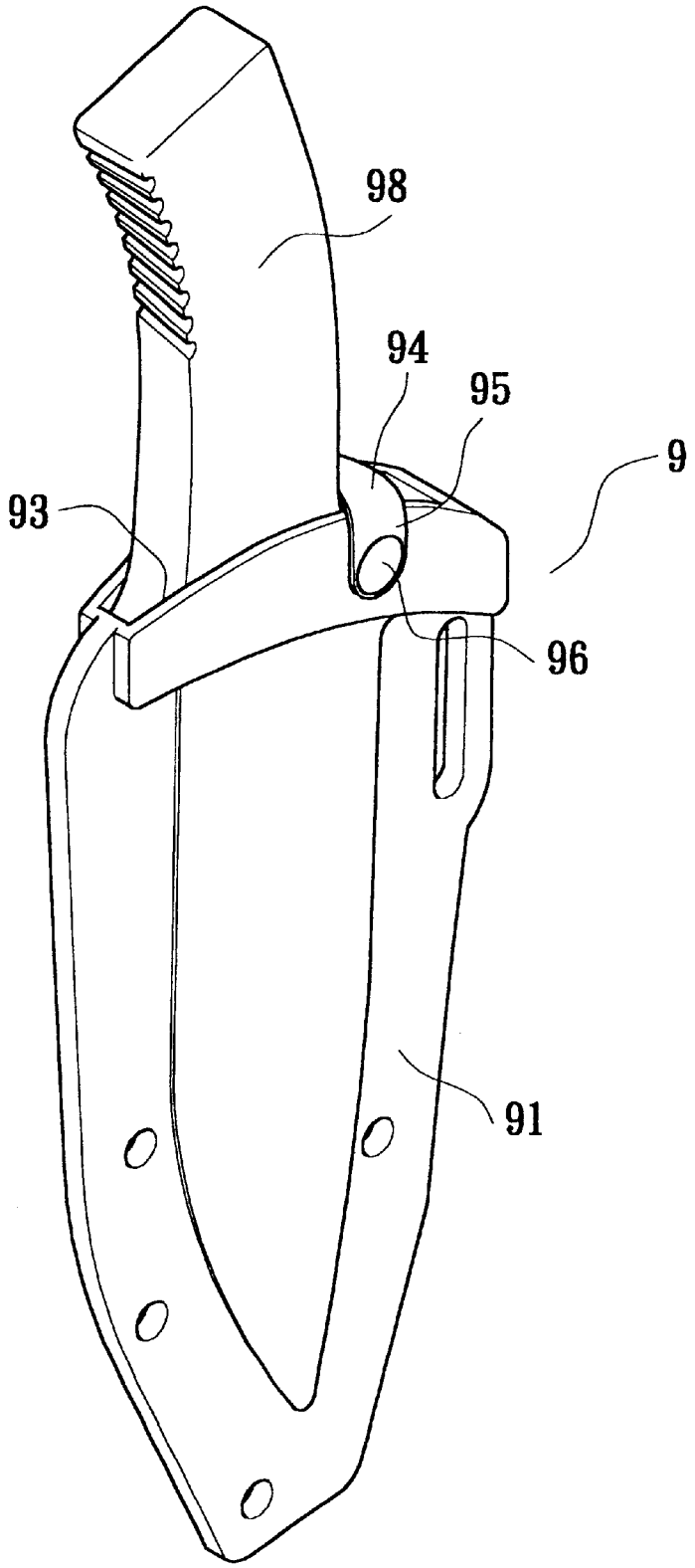
PRIOR ART FIG. 5
FIG. 5 is a perspective view of a type of conventional knife and knife sheath.
Figure 6:
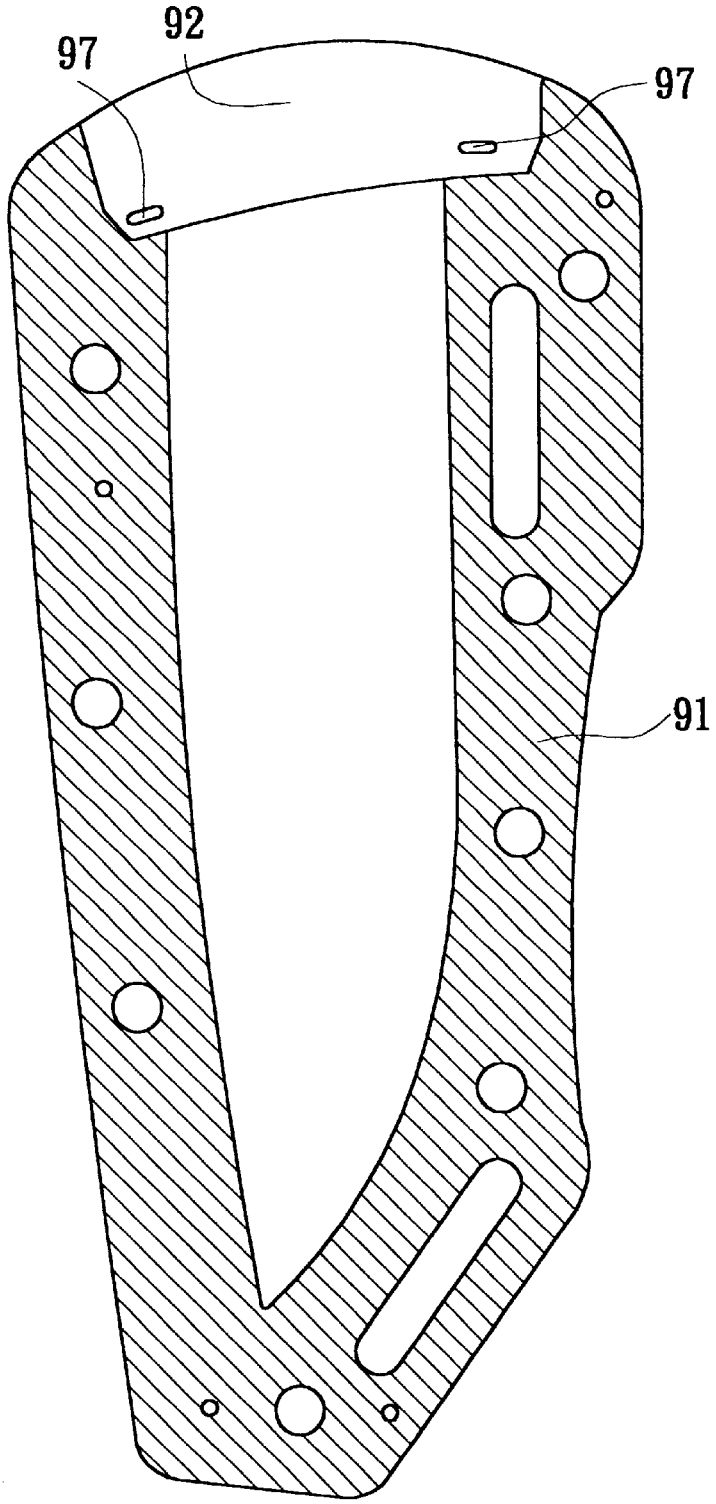
PRIOR ART FIG. 6
FIG. 6 is a sectional view of another type of conventional knife and knife sheath.

FIG. 4 shows a second embodiment of the present invention, in which the fixing section 23 does not outward extend as in the first embodiment. The fixing section 23 has a guide face 231 directed to the blade 22 and a stop face 232 back to the blade 22. When the knife 2 is fitted in the knife sheath 3, in normal state, the stop block 352 is engaged with the stop face 232 to fix the knife 2 in the knife sheath 3. In this embodiment, the knife 2 can be extracted by the same operation as the first embodiment.

The above embodiments are only used to illustrate the present invention, not intended to limit the scope thereof. Many modifications of the above embodiments can be made without departing from the spirit of the present invention.

What is claimed is:

1. An anti-detachment structure for a knife and knife sheath, comprising:

a knife having a handle and a blade, the handle having a fixing section having a guide face directed to the blade and a stop face back to the blade, said stop face having a wave contour, the glide face and the stop face defining a ridge section; and a knife sheath having a receiving space with a profile complementary to die blade for receiving the blade, the receiving space having an opening defined by an opening periphery of the knife sheath, a resilient member and a linearly movable driving block being disposed in the knife sheath corresponding to the fixing section, the driving block having a push face and a stop block, the push face extending out of die knife sheath and being positioned on the opening periphery, the stop block having an outer end face facing the opening periphery and an inner end face contacting with the resilient member, whereby in normal state, die stop block is engaged with the stop face of the handle to fix the knife in the knife sheath.

2. The anti-detachment structure for a knife and knife sheath as claimed in claim 1, wherein a user's thumb pushes the push face to make the stop block compress the resilient member so as to entirely push away the driving block, permitting the knife to be extracted out of the knife sheath.

3. The anti-detachment structure for a knife and knife sheath as claimed in claim 1, wherein the guide face of the fixing section of the knife pushes the outer end face of the stop block so as to push away the stop block, permitting the blade to be inserted into the knife sheath.

4. The anti-detachment structure for a knife and knife sheath as claimed in claim 1, wherein the guide face of the fixing section and the outer end face of the stop block are slopes corresponding to each other.

5. The anti-detachment structure for a knife and knife sheath as claimed in claim 1, wherein the resilient member is a spring.

6. The anti-detachment structure for a knife and knife sheath as claimed in claim 1, wherein a protective plate outward extends from a lateral side of the opening, whereby when a user wears the knife sheath, the protective plate is attached to the user's body and positioned between the knife and the user's body.

7. The anti-detachment structure for a knife and knife sheath as claimed in claim 6, wherein the protective plate only outward extends from the lateral edge of the opening near the fixing section.

* * * * *